US006637335B2

(12) United States Patent
Jentzsch

(10) Patent No.: US 6,637,335 B2
(45) Date of Patent: Oct. 28, 2003

(54) PROCESS AND APPARATUS FOR IMAGING SURFACES IN PRINTING MACHINES

(75) Inventor: Arndt Jentzsch, Coswig (DE)

(73) Assignee: Koenig + Bauer AG, Wurzburg (DE)

( * ) Notice: Subject to any disclaimer, the term of this patent is extended or adjusted under 35 U.S.C. 154(b) by 0 days.

(21) Appl. No.: 09/899,752

(22) Filed: Jul. 5, 2001

(65) Prior Publication Data

US 2003/0005834 A1 Jan. 9, 2003

(30) Foreign Application Priority Data

Jul. 5, 2000 (DE) ..... 100 32 703

(51) Int. Cl.[7] ..... B41C 1/10; B41F 35/02

(52) U.S. Cl. ..... 101/463.1; 101/401.1; 101/425; 101/467; 101/478

(58) Field of Search ..... 101/463.1, 465–467, 101/478, 401.1, 425

(56) References Cited

U.S. PATENT DOCUMENTS 3,983,813 A * 10/1976 Tani ..... 101/425
4,718,340 A * 1/1988 Love, III ..... 101/467
4,846,065 A * 7/1989 Mayrhofer et al. ..... 101/467
5,129,321 A * 7/1992 Fadner ..... 101/467
5,148,746 A * 9/1992 Fuller et al. ..... 101/425
5,644,987 A * 7/1997 Eltgen ..... 101/478
5,713,287 A * 2/1998 Gelbart ..... 101/478
5,943,956 A * 8/1999 Marquez et al. ..... 101/425
5,996,499 A * 12/1999 Gelbart et al. ..... 101/467
6,180,325 B1 * 1/2001 Gelbart ..... 430/300

* cited by examiner

*Primary Examiner*—Stephen R. Funk
(74) *Attorney, Agent, or Firm*—Goodwin Procter LLP

(57) ABSTRACT

The invention relates to an apparatus for imaging surfaces in printing presses, whereby the surfaces to be imaged contains image information of the preceding printing job. The apparatus allows a fast and low-cost regeneration of surfaces carrying image information in printing presses. The apparatus comprises at least one printing form cylinder, a disengageable inking unit, and a movable imaging unit having an image creation unit for applying image information to image and non-image carrying layers on the surface. The imaging unit has an erasing unit preceding the movable imaging unit in the moving direction.

12 Claims, 4 Drawing Sheets

PROCESS AND APPARATUS FOR IMAGING SURFACES IN PRINTING MACHINES

FIELD OF THE INVENTION

The invention relates to a method for imaging a surface, whereby the surface to be imaged contains image information of the preceding printing job. The printing machine has a least a printing form cylinder cooperating with an inking unit and possibly with a dampening unit and a blanket cylinder.

The invention also relates to an apparatus for imaging a surface in a printing press, where the printing machine has at least a printing form cylinder cooperating with an inking unit to be switched off and optionally with a dampening unit to be switched off, a blanket cylinder and an imaging unit for applying an image information carrying layer.

BACKGROUND OF INVENTION

A process for regenerating a preferably prior imaged printing form for offset printing is known from German patent No. 41 23 959 C1. The regeneration of the printing plate involves the image removal from the printing form and the making of the printing form surface hydrophilic. Applying an ionized process gas through an applying device regenerates the printing form. The image is reactively erased and is simulataneosuly made hydrophilic in one process step. A suction device removes the created gaseous products of this reaction.

The time consuming regeneration of the printing plate is undesirable.

SUMMARY DESCRIPTION OF INVENTION

It is an object of the invention to realize a process and an apparatus for a fast and low-cost regeneration of surfaces carrying image information in printing presses.

The object is solved according the invention by applying an ink receptive layer carrying the actual image information on the ink-repelling imaging surface within one operation. The existing image information from the preceding printing job is erased during this operation by a preceding erasing unit.

The advantage with this invention is the considerable reduction of make-ready time for printing presses.

BRIEF DESCRIPTION OF THE DRAWING

The invention is described below in greater detail by an embodiment of the invention, by reference being had to the drawing, wherein.

DETAILED DESCRIPTION

Figure 1:
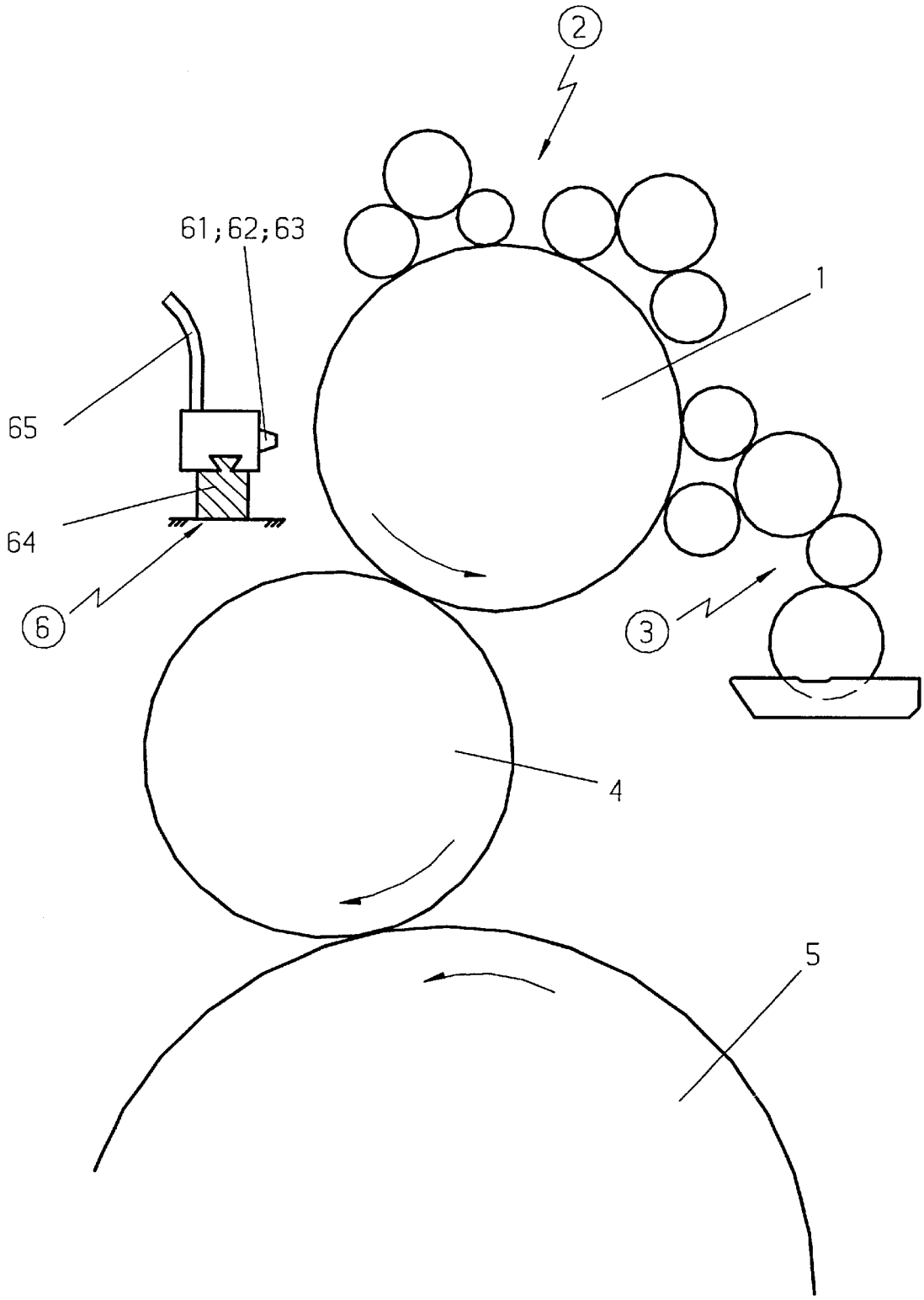
FIG. 1 is a schematic arrangement of the cylinder and roller allocation in a printing unit of an offset printing press with imaging unit

FIG. 1 shows the upper part of a printing tower of a sheet fed offset press with an impression cylinder 5, a blanket cylinder 4 and a printing form cylinder 1. These cylinders contact each other during the printing process. An inking unit 2 and a dampening unit 3 are allocated to the printing form cylinder 1. Equipment not shown can remove inking unit 2, dampening unit 3 and blanket cylinder 4 from the contact with the printing form cylinder 1 when required. The printing form cylinder can also carry a printing plate (not shown) to take the image. It is also possible to put a sleeve on the printing form cylinder 1.

Figure 2:
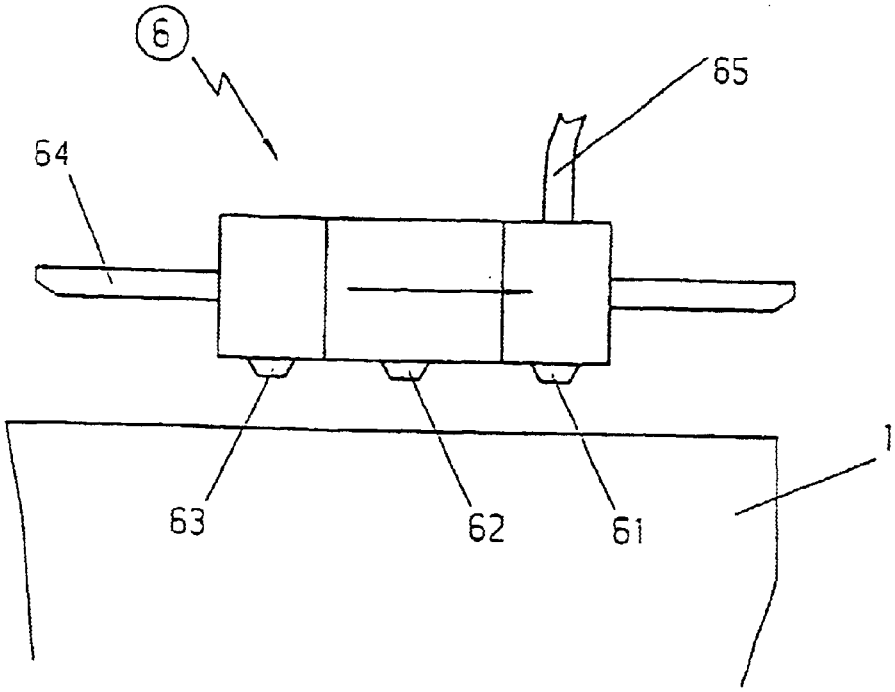
FIG. 2 is the structure of the imaging unit

An imaging unit 6 is allocated to the printing form cylinder 1. This imaging unit 6 transverses axially to printing form cylinder 1 on a crossbar 64 and is mounted in the frame of the printing press. FIG. 2 shows the structure of such an imaging unit 6.

Main part of the imaging unit 6 is an image creation unit 62. The image creation unit 62 operates in the illustrated embodiment with the ink-jet principle. It is also possible to use other application devices. One not shown embodiment uses, for example, a laser radiated transfer foil.

The image creation unit 62 has an erasing unit 61 integrated into the imaging unit 6 in the direction of the motion (arrow in FIG. 2) of the imaging unit 6. The erasing unit 61 has a laser with a suction device 65. A hardening unit 63 follows the image creation unit 62. The hardening unit 63 uses a laser. It is also possible to use UV light instead of the laser.

Figure 3:
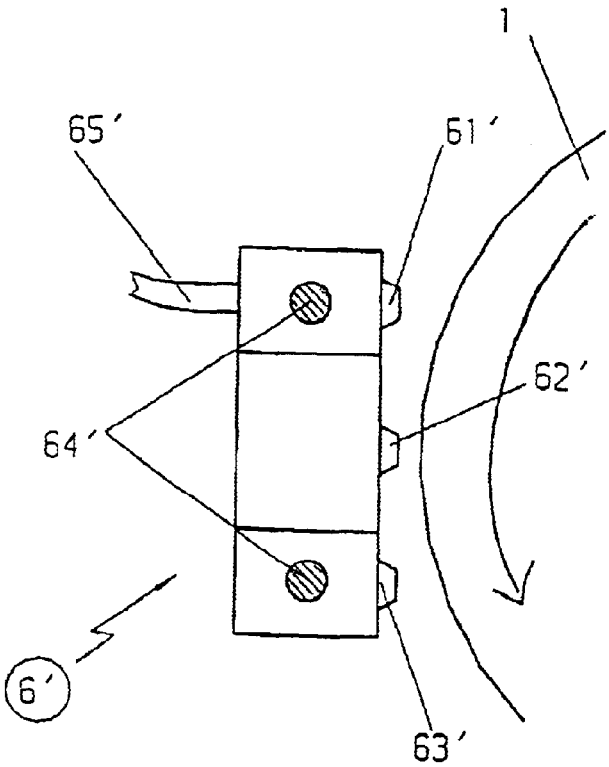
FIG. 3 is the structure of the imaging unit in another embodiment

In another embodiment of the invention (FIG. 3) the integrated erasing unit 61', die image creation unit 62' and the hardening unit 63' are mounted one after another in the direction of the motion (arrow in FIG. 3) of the printing form cylinder 1. The erasing unit 61' has a suction device 65'. The imaging unit 6' transverses axially analogously to the imaging unit 6 axially on a crossbar 64'.

Figure 4:
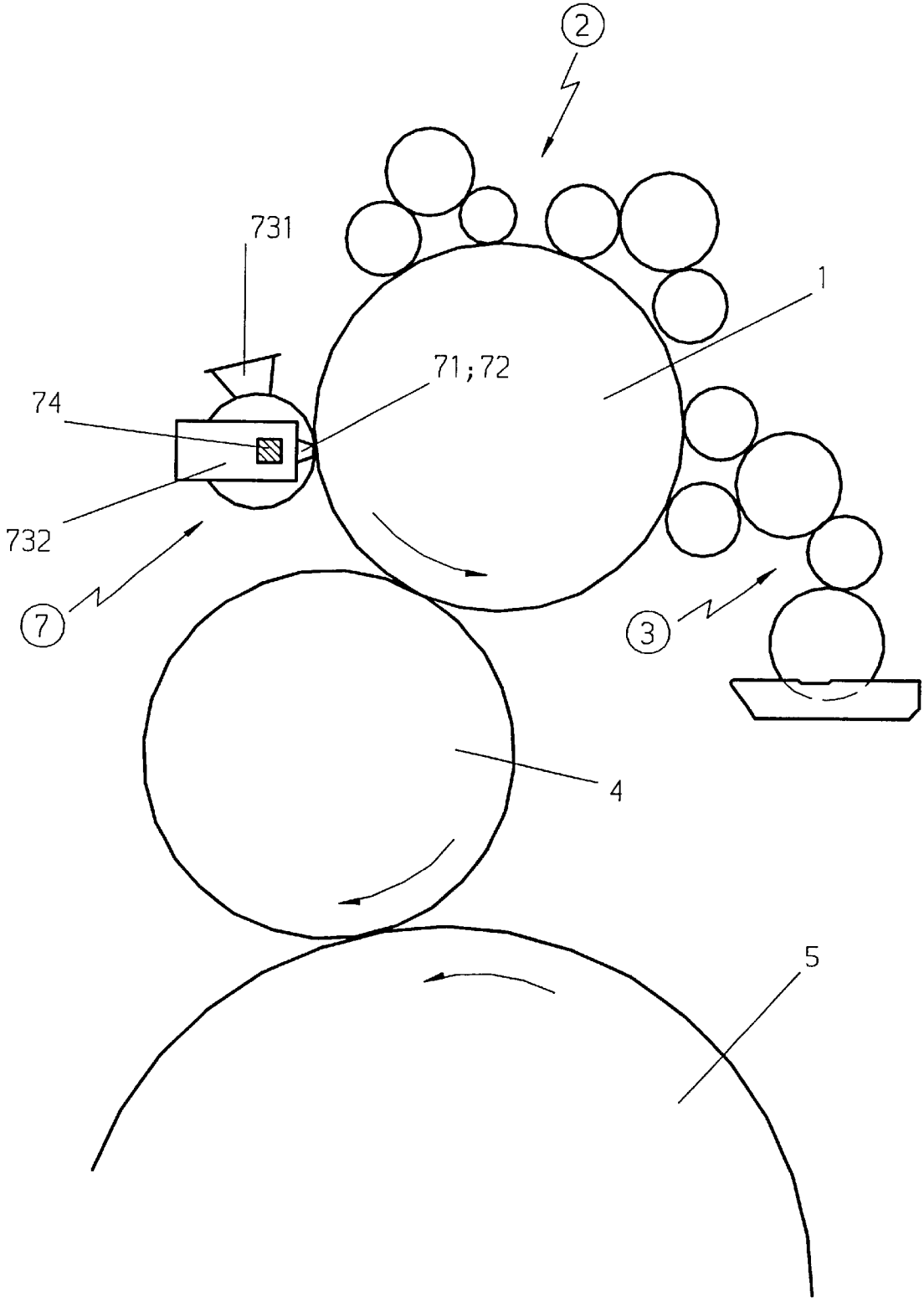
FIG. 4 is a schematic arrangement of the cylinder and roller allocation in a printing unit of a sheet fed offset printing press with imaging unit and integrated coating unit.
Figure 5:
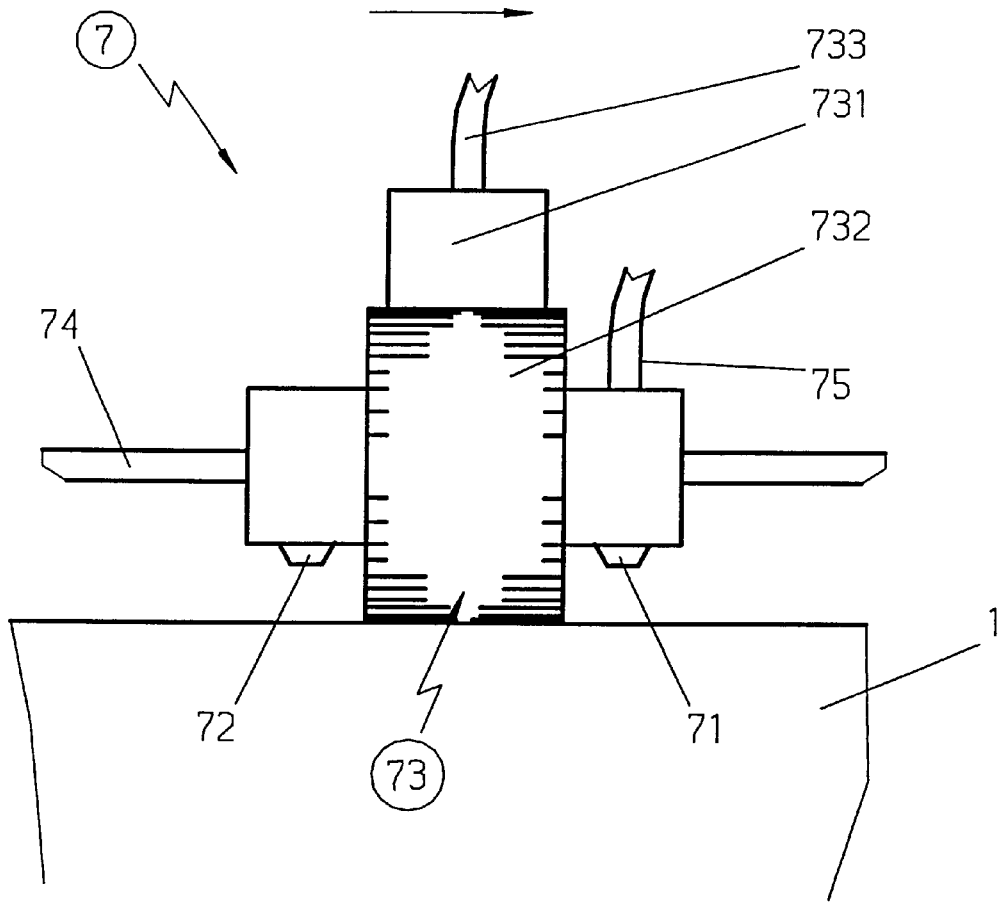
FIG. 5 is the structure of the imaging unit according to FIG. 4

FIG. 4 shows together with FIG. 5 a further embodiment of the invention. An imaging unit 7 is axially transversing on a crossbar 74. The imaging unit 7 has a coating unit 73 with a preceding erasing unit 71 including suction device 75. An image creation unit 72, whereby also a hardening unit (not shown) can be allocated, follows the coating unit 73. The image creation unit 72 is embodied as an ablation laser.

The coating unit 73 has a screened roller 732 with a doctor blade 731, including the necessary supply lines 733. Other coating devices such as spray devices can also be used.

The erasing unit 71, the coating unit 73 and the image creation unit 72 can also be arranged one after another in the rotational direction of the printing form cylinder 1. The process of the present invention is realized in the following manner: The printing unit including the printing form cylinder 1 is washed after a printing job is finished. The inking unit 2, the dampening unit 3 and the blanket cylinder 4 are removed from contact with the printing form cylinder 1. It is also possible to disengage the printing form cylinder 1. The imaging of the printing form cylinder 1, the printing plate or the sleeve, respectively starts afterwards. The data is provided by a digital memory.

At the beginning of the imaging process the imaging unit 6 is outside of the printing area at the outer edge of the printing form cylinder 1. The imaging unit 6 moves in axial direction (arrow in FIG. 2) for imaging. The laser of the erasing unit 61 impacts upon a layer from the preceding printing job. This layer evaporates from the laser radiation and is sucked off by the suction device 65. The erased zones of the printing form cylinder 1 are now reaching the range of the image creation unit 62 by the axial movement of the imaging unit 6. The image creation unit applies a coating containing the image information to the printing form cylinder 1. In one embodiment of the invention the coating is made with an ink receptive coating material on the ink-repelling surface of the printing form cylinder 1 or the surface of the printing form. Thus the ink receptive layer carries the image information of the actual printing job.

In another embodiment of the invention the coating is made with ink repelling coating material on an ink receptive surface. The image carrying elements are here the non-coated areas of the surface of the printing form cylinder 1 or the printing form. The coating material is applied through ink-jet in one step to the surface to be coated. In another variant the layer carrying the image information is applied to the image surface by a transfer foil in cooperation with a laser. The medium on the transfer foil is transferred from the transfer foil to the image surface by the thermal impact of the laser.During the continued movement of the imaging unit 6 the coated zones are getting to the hardening unit 63, which hardens the layer by laser or UV light. The process goes on continually until the imaging unit 6 reaches the other side of the printing form cylinder 1. The coating is finished within one operating step and the printing of the new printing job can start. The inking unit 2, the dampening unit 3 and possibly the blanket cylinder 4 are now engaged for this purpose to the printing form cylinder 1. The printing form cylinder 1 will be engaged too if applicable. Now the inking of the printing plate respectively of the surface of the printing form cylinder 1 can start and the actual printing job can be printed.

The process of the present invention can also be realized with the apparatus shown in FIG. 4. The existing image information is erased, the actual image information is transferred and hardened in one track by the arrangement of erasing unit 61'. The image creation unit 62' and hardening unit 63' are perpendicular to the axis of the printing form cylinder 1. The apparatus shown in FIG. 4 and FIG. 5 can also be realized a further embodiment of the invention. In this process the imageable layer is transferred to the printing form cylinder in the following manner: The erasing unit 71 removes the existing image carrying layer from the surface of the printing form cylinder respectively from the printing plate. The remaining parts are sucked off. The coating unit 73 applies a coating to the surface of the printing form cylinder 1 respectively to printing plate during the movement of the imaging unit 7.

In another variant of this embodiment an ink receptive layer is applied to the coated surface within one step. The surface is ink repelling in this case. Afterwards the layer receives the image by the image creation unit 72 and is hardened if applicable. During this process the ink receptive layer is removed in the no image carrying areas by an ablation laser, so that the ink repelling surface of the printing form cylinder respectively the printing plate is laid bare.

This process can be advantageously combined with erasing and coating of the image layer. It can also be made in a separate operating cycle.In another embodiment the ink-repelling layer is put on top of the ink receptive surface of the printing form cylinder respectively the printing plate. The imaging now removes the ink-repelling layer in the image carrying areas, so that the ink receptive surface is laid bare. Now the actual printing of the printing job can start. The inking unit 2, the dampening unit 3 and the blanket cylinder 4 if applicable are engaged to the printing form cylinder 1. The printing form cylinder 1 is also engaged if applicable. The usual inking of the printing plate and of the surface of the printing form cylinder 1, respectively, begins and the printing job can proceed.

I claim:

1. Apparatus for imaging a surface in a printing machine having at least one printing form cylinder, a disengeable inking unit, optionally a disengageable dampening unit cooperating with said printing form cylinder, an optional blanket cylinder cooperating with said printing form cylinder, and a movable imaging unit having an image creation unit for applying image information to image and non-image carrying layers on said surface, said imaging unit having an erasing unit preceding said movable imaging unit in the direction of its motion.

2. The apparatus of claim 1, further comprising a device for disengaging said blanket cylinder from said printing form cylinder.

3. The apparatus of claim 1, wherein said image creation unit has an ink-jet for applying the layer carrrying the image information.

4. The apparatus of claim 1, wherein said image creation unit applies the image information with a laser-irradiated transfer foil.

5. The apparatus of claim 1, further comprising a hardenening unit integrated with said image creation unit, for hardening the layer carrying the image information.

6. An apparatus for imaging a surface in a printing press having at least one printing form cylinder, a disengageable inking unit, an optional disengageable dampening unit cooperating with the printing form cylinder, an optional blanket cylinder cooperating with the printing form cylinder, a transversing imaging unit having an image creation unit for applying a layer, and an ablation laser for the imaging surface, said imaging unit having an integral erasing unit preceding said image creation unit in the direction of transversing motion.

7. The apparatus of claim 6, further comprising a hardening unit integral with said imaging unit.

8. The apparatus of claim 6, further comprising a suction device integral with said imaging unit.

9. The apparatus of claim 6, further comprising a doctor blade for applying the layer to the surface.

10. The apparatus of claim 6, further comprising a spraying device for applying the layer to the surface.

11. The apparatus of claim 6, wherein said integral erasing unit is a laser.

12. The apparatus of claim 6, wherein said imaging unit contains a suction device for removing the remainder of a previous image.

* * * * *